US012590426B2

(12) United States Patent
Baker

(10) Patent No.: US 12,590,426 B2
(45) Date of Patent: Mar. 31, 2026

(54) CRAWLER BRIDGE

(71) Applicant: Calbah Industries Pty Ltd, Dandenong South (AU)

(72) Inventor: Chester Baker, Dandenong South (AU)

(73) Assignee: Calbah Industries Pty Ltd (AU)

( * ) Notice: Subject to any disclaimer, the term of this patent is extended or adjusted under 35 U.S.C. 154(b) by 534 days.

(21) Appl. No.: 18/254,205

(22) PCT Filed: Nov. 24, 2021

(86) PCT No.: PCT/AU2021/051404
§ 371 (c)(1),
(2) Date: May 24, 2023

(87) PCT Pub. No.: WO2022/109669
PCT Pub. Date: Jun. 2, 2022

(65) Prior Publication Data

US 2024/0093442 A1 Mar. 21, 2024

(30) Foreign Application Priority Data

Nov. 24, 2020 (AU) ..... 2020904342

(51) Int. Cl.
*E01D 15/10* (2006.01)
*E01D 15/12* (2006.01)
*E01D 21/06* (2006.01)

(52) U.S. Cl.
CPC ..... *E01D 15/10* (2013.01); *E01D 15/12* (2013.01); *E01D 21/06* (2013.01)

(58) Field of Classification Search
CPC ..... E01D 15/02; E01D 15/10; E01D 15/12; E01D 21/06
See application file for complete search history.

(56) References Cited

U.S. PATENT DOCUMENTS 5,511,268 A * 4/1996 Albus ..... E01D 21/06 212/312
7,520,014 B2 * 4/2009 Homsi ..... E01D 19/103 14/77.3

(Continued)

FOREIGN PATENT DOCUMENTS

CN 115595881 A * 1/2023 ..... E01D 21/00
CN 118029275 A * 5/2024 ..... E01D 19/125

(Continued)

OTHER PUBLICATIONS

International Search Report and Written Opinion dated Dec. 24, 2021 in PCT Application No. PCY/AU2021/051404, 3 pages.

*Primary Examiner* — Gary S Hartmann
(74) *Attorney, Agent, or Firm* — HOVEY WILLIAMS LLP

(57) ABSTRACT

A crawler bridge (10) having a bridge section (12) for bridging across opposite sides of a gap G. The bridge section (12) being connected to a support structure (14) which has a pair of elongate beams (16,17), that are spaced apart and generally parallel. The beams (16,17) each including leading and trailing feet (18,19). The bridge section (12) is attached to the beams (16,17) for relative movement forward and backward along the beams (16,17) and vertically up and down. The crawler bridge (10) has a first mode of operation when the leading and trailing feet 18,19 of the beams (16,17) are in engagement with a ground surface, in which the bridge section (12) is supported by the support structure (14) elevated above the ground surface and is movable forward and backward along the beams (16,17) and vertically up and down. The crawler bridge (10) has a second mode of operation when the bridge section (12) has been moved downward relative to the beams (16,17) and into engagement with a supporting surface, in which the leading and trailing feet (18,19) of the beams (16,17) are lifted away (Continued)

from the supporting surface and the beams (16,17) are movable forward and backward relative to the bridge section (12) and vertically up and down relative to the bridge section (12).

20 Claims, 3 Drawing Sheets

(56) References Cited

U.S. PATENT DOCUMENTS

| | | | | |
|---|---|---|---|---|
| 8,671,490 | B1 * | 3/2014 | Carney | E01D 22/00 14/2.4 |
| 9,163,367 | B2 * | 10/2015 | Carney | B66C 19/02 |
| 9,969,601 | B2 * | 5/2018 | Carney | H04L 67/1001 |
| 11,053,101 | B2 * | 7/2021 | Carney | G06F 9/45558 |
| 2008/0301889 | A1 * | 12/2008 | Kang | E01D 21/06 14/77.1 |
| 2019/0016568 | A1 * | 1/2019 | Pan | B66C 17/20 |
| 2019/0016570 | A1 * | 1/2019 | Carney | B66C 5/04 |

FOREIGN PATENT DOCUMENTS

| | | | | |
|---|---|---|---|---|
| CN | 118166671 A | * | 6/2024 | E01D 21/06 |
| CN | 115595881 B | * | 5/2025 | E01D 21/06 |

* cited by examiner

CRAWLER BRIDGE

CROSS-REFERENCE TO RELATED APPLICATIONS

The current patent application is a national stage patent application under 35 U.S.C. § 371 of International Application No. PCT/AU2021/051404, filed Nov. 24, 2021, which claims priority to Australian Patent Application No. AU2020904342, filed Nov. 24, 2020, the entire disclosures of which are hereby incorporated by reference herein.

TECHNICAL FIELD

The present invention relates to a travelling bridge that has been developed for use in underground tunnels for providing a bridge for spanning openings or breaks in the floor of the tunnel. The travelling bridge of the present invention has been specifically developed for use in tunnels in which road or railways are constructed and which require the construction of cross passages to connect adjacent tunnels. It will be appreciated however, that the invention is not limited to this form of use. The travelling bridge of the invention is alternatively known as a "crawling bridge" or a "crawler bridge" and the latter expression will be used hereinafter to describe the travelling bridge of the invention.

BACKGROUND OF THE INVENTION

The discussion of the background to the invention that follows is intended to facilitate an understanding of the invention. However, it should be appreciated that the discussion is not an acknowledgement or admission that any aspect of the discussion was part of the common general knowledge as at the priority date of the application.

Underground tunnels formed for road or rail use are usually formed in tunnel pairs so that vehicles travelling in a first direction can be quarantined in one tunnel, away from vehicles travelling in a second and opposite direction in the other tunnel. This provides safety against collisions between vehicles travelling in opposite directions. This is similar to above ground roadways which employ barriers between lanes to separate vehicles travelling in opposite directions. Thus, a pair of tunnels can be constructed side-by-side with a first of the tunnels providing for travel in a first direction and the second of the tunnels providing for travel in a second and opposite direction, with tunnel walls separating vehicles travelling in the respective tunnels.

In these arrangements, cross passages are provided to connect adjacent tunnels, for the purpose of allowing communication between the tunnels, for example to allow people to escape from one tunnel to the other in an emergency, such as during a fire or flood, as well as to facilitate tunnel services i.e. cabling and piping to cross between adjacent tunnels.

In tunnel construction, the cross passages are usually constructed later on in the tunnel construction process. Usually, tunnel excavation proceeds past one or more cross passage sites before cross passage construction commences. In some tunnels, the cross passages are one of the final stages in tunnel construction. This is because the equipment used to create the cross passages will usually impede the equipment and services that are used to excavate the tunnel ahead of the cross passages and in terms of importance, tunnel excavation and construction usually takes precedence over cross passage excavation and construction.

In one form of tunnel construction, an excavation of circular cross-section is made and lined, and a road deck is installed extending across the tunnel from one side to the other. The road deck typically will extend across the tunnel at or in the region of the maximum diameter of the tunnel to give the road deck maximum width and this means that the road deck will be elevated well above the base of the tunnel. The road deck can be supported in the elevated position at opposite sides to leave a void below the road deck which conveniently forms a service tunnel. The service tunnel can be large enough to accommodate vehicles and personnel, as well as various tunnel services, including drainage for example. The height of the void can be in the order of about 2.5-3 m at a central region thereof. In tunnel construction of this kind, it is an option is to omit sections of the road deck that are adjacent or aligned with proposed cross passages, as those sections will in any case, subsequently be removed to create the cross passages if they are installed as part of the road deck. A downside to this approach is that a gap that overlies the void below is created in the road deck. The gap can be in the order of 7 m long. The gap precludes the passage of construction vehicles past the gap and so for that purpose, a temporary bridge must be installed over the gap so that tunnel excavation and construction can continue. This takes time and the temporary bridge must be removed for the subsequent cross passage construction.

The present invention seeks to provides a temporary bridge that overcomes or at least has less drawbacks than those that are associated with the present temporary bridge arrangements.

SUMMARY OF THE INVENTION

According to one form of the invention there is provided a crawler bridge having:

a. a bridge section for bridging across opposite sides of a gap, b. the bridge section being connected to a support structure, c. the support structure including a pair of elongate beams that are spaced apart and generally parallel, the beams each including leading and trailing feet that extend downwardly from the beams for engagement with a ground surface, d. the bridge section being attached to the beams for relative movement forward and backward along the beams and vertically up and down relative to the beams, e. the crawler bridge having a first mode of operation when the leading and trailing feet of the beams are in engagement with a ground surface, in which the bridge section is supported by the support structure elevated above the ground surface and is movable forward and backward along the beams and vertically up and down relative to the beams, and f. the crawler bridge having a second mode of operation when the bridge section has been moved downward relative to the beams and into engagement with a supporting surface, in which the leading and trailing feet of the beams are lifted away from the supporting surface and the beams are movable forward and backward relative to the bridge section and vertically up and down relative to the bridge section.

A crawler bridge according to the invention advantageously facilitates movement of the bridge along a tunnel excavation by utilising the first and second modes of operation, whereby each of the beams and the bridge section can be moved forward and backward within a tunnel. Moreover, the crawler bridge advantageously can locate the bridge section across a gap in the floor of the tunnel (for example where the floor of the tunnel is a road deck and the gap being where a section of road deck has been omitted for the later construction of a cross passage) without first requiring access to the opposite side of the gap in the direction from which the crawler bridge is approaching the gap. That is, the crawler bridge can approach a gap from a first side and then the beams can be made to traverse across the gap via the second mode of operation described above, to place the leading feet of the beams on the opposite or second side of the gap while maintaining the trailing feet of the beams on the first side. Advantageously, there is no need for access to the second side of the gap for the placement of the leading feet on the second side. This distinguishes the invention from prior art arrangements in which access to both sides of the gap is required to form a bridge across the gap. Access to both sides of a gap is not necessarily always available or easy, given that the reason for forming the bridge is to provide access to the other side of the gap, so placing equipment on the other side of the gap for the purpose of forming the bridge can be difficult and time consuming.

The first mode of operation can be utilised once the crawler bridge has been installed in a tunnel with the leading and trailing feet of the beams in engagement with a ground or floor surface of the tunnel; a road or base surface for example, and the bridge section is elevated about the road or base surface, supported by the beams. In this mode, the bridge section can be moved forward relative to the beams to position the bridge section close to or adjacent the leading feet of the beams. The second mode of operation can then be utilised to lower the bridge section into engagement with the road or base surface of the tunnel to lift the feet of the beams from engagement with the road or base surface. The beams are then free to move relative to the bridge section forward or backwards. Forward movement of the beams will reposition the beams relative to the road or base surface and relative to the bridge section, so that the bridge section will be moved from a position close to or adjacent the leading feet of the beams, to a position closer to or adjacent the trailing feet of the beams. In that position, the beams can be lowered relative to the bridge section to re-engage the leading and trailing feet on the road or base surface and to lift the bridge section away from the road or base surface. The bridge section can now be moved again in accordance with the first mode of operation, relative to the beams to bring the bridge section into close proximity with the leading feet of the beams. By shifting between the first and second modes of operation, the crawler bridge can move or "walk" forward along the road or base surface of a tunnel.

When the crawler bridge encounters a gap or break in the road or base surface, the bridge section can be positioned to overlie the gap and to provide a road surface for passage of vehicles over and past the gap. Thus, the second mode of operation can be employed to shift the beams to extend across the gap so that the leading and trailing feet can be lowered into position on opposite sides of the gap and once in that position, the first mode of operation can be employed to shift the bridge section along the beams so that it is aligned with the gap and can then be lowered into position across the gap, forming a bridge between opposite edges of the gap.

More specifically, at the initial installation of the crawler bridge, the crawler bridge can be in any state in relation to the position of the beams and the bridge section relative to the ground surface. For example, the leading and trailing feet of the beams can be resting on the ground surface and the bridge section can be elevated above the ground surface. Alternatively, the leading and trailing feet can be elevated above the ground surface and the bridge section can be resting on the ground surface. Still alternatively, both of the leading and trailing feet and the bridge section can be resting on the ground surface. But once movement of the crawler bridge is required, the most appropriate of the first or second modes of operation is initiated, depending on the position of the bridge section relative to the beams. Thus, if the bridge section is close to the trailing feet of the beams, the first mode of operation might be initiated first to move the bridge section towards the leading feet of the beams. Thereafter, the crawler bridge can crawl along the tunnel floor by successive switching between the first and second modes of operation.

Eventually a gap in the road or base surface of the tunnel floor will be encountered, for which the bridge section is to be used to provide a bridge across the gap to allow travel of vehicles. When approaching that gap, the first and second modes of operation must be carefully selected so enable the leading and trailing feet of the beams to be placed on either side of the gap, so that the bridge section can subsequently be aligned with the gap and can then be lowered into position across the gap. Typically, the crawler bridge will be positioned so that with the leading and trailing feet of the beams in engagement with the road or base surface, the leading feet are positioned adjacent the proximal edge of the gap in the direction of travel of the crawler bridge towards the gap and the bridge section is close to or adjacent the leading feet of the beams. The bridge section can then be lowered into engagement with the road or base surface according to the second mode of operation and the leading and trailing feet can be lifted away from the road or base surface and the beams can be shifted relative to the bridge section to move the leading feet over the gap to the other side of the gap such as to a position adjacent the distal edge of the gap. The leading and trailing feet are now in position on opposite sides of the gap and can be lowered into engagement with the road or base surface on the opposite sides of the gap.

The bridge section can now be lifted away from the road or base surface in accordance with the first mode of operation and can be moved along the beams to overlie the gap and once properly aligned with the gap, the bridge section can be lowered to bridge across the gap and to provide a road surface for passage of vehicles over and past the gap. At this point, if desirable, the leading and trailing feet of the beams can be lifted away from the road or base surface to move the beams relative to the bridge section to shift the leading feet away from the distal edge of the gap so as to bring the leading and trailing feet to approximately equal distances from the respective proximal and distal edges of the gap. This requires that the bridge section be supported at each of the proximal and distal edges of the gap.

In the operative position of the bridge section in which it bridges across the gap, the leading and trailing feet of the beams can be lowered into engagement with the road or base surface on either side of the gap for providing increased stabilisation of the crawler bridge.

Once there is no longer a need for the bridge section to bridge across the gap, the bridge section can be lifted and in accordance with the first mode of operation, it can be moved to the distal side of the gap to a position at which it can be lowered into engagement with the road or base surface on the distal side of the gap and preferably close to or adjacent the leading feet of the beams and thereafter, it can be lowered into engagement with the road or base surface to facilitate transition to the second mode of operation to lift or elevate the beams and then to shift the beams fully to the distal side of the gap. Thereafter, the crawler bridge can crawl along the road or base surface by successive switching between the first and second modes of operation until the next gap is reached, at which time the process described above can be implemented to place the bridge section across the gap to provide a road surface for passage of vehicles over and past the gap.

In the operative position of the bridge section, the bridge section can be suspended from the beams and supported in the operative position by that suspension. Alternatively, the bridge section can bear on the road deck or tunnel floor on either side of the gap and be located relative to the gap by that bearing engagement with the road deck or tunnel floor.

The bridge section can take any suitable form. For suspending the bridge section from the beams, the support structure can include arms that extend from the bridge section into engagement with the beams and the arms can include a roller arrangement for rolling along the beams, such as along the top of the beams, or along a flange of the beams. The roller arrangement can include a roller drive so that movement of the bridge section along the beams in the first mode of operation is driven by one or more rollers that are driven to rotate forwards or backwards. The driven rollers can drive by friction against a surface of the beams or the rollers could be formed with teeth and drive along a toothed rack. The rollers could have a rubber rolling surface for example if friction drive is employed, or the rollers could be metal if they have a toothed form. Alternatively, the bridge section can move relative to the beams by a cable and pulley arrangement. Other arrangements, such as screw drive or magneto drive could be employed. These arrangements can drive the bridge section along the beams and likewise can drive the beams relative to the bridge section in the second mode of operation.

The arms can be telescopic for lifting and lowering the bridge section. They can be pneumatically or hydraulically operated such as by struts. Alternatively, the arms can be lifted and lowered by a geared arrangement such as rack and pinion, or by a screw drive.

The bridge section would typically remain suspended beneath the beams in the first mode of operation, although in some arrangements, the bridge section might be lifted between the beams or even above the beams. This level of lifting could allow the crawler bridge to move past equipment or other objects within the tunnel by passing the bridge section over that equipment or objects.

The bridge section can include a deck which has an upper surface for travel over the bridge section. The bridge section can further include leading and trailing feet for engagement with the road deck, tunnel floor or ground surface on either side of a gap the bridge section traverses to fully or partially support the bridge section in place relative to the gap. The feet of the bridge section can extend downwardly like the feet of the beams for engagement with a ground surface, or the feet can be a section of the bridge section that extends to overlie the ground surface on either side of the gap. For example, the deck might have a longitudinal dimension that will extend fully across the gap and to overlie the ground surface on either side of the gap and the underside of the deck at either end of the deck will form the leading and trailing feet.

Alternatively, the bridge section can have a deck of the above described kind, and rails or beams (hereinafter 'rails') that support the deck and that extend at either end to overlie the ground surface on either side of the gap. Two rails can be provided at either side of the deck. A further central rail and further additional rails could be provided if required, such as for strength purposes. In this arrangement, the ends of the rails can constitute the leading and trailing feet, or downwardly extending feet can be attached to the ends of the rails.

In the above arrangement, the deck can be connected to the rails in a manner that the lower surface of the rails is at approximately the same height as the upper surface of the deck, so that with the lower surface of the rails extending to rest on the ground surface on either side of the gap, the upper surface of the deck is close to the ground surface on either side of the gap so that vehicles travelling along the ground surface and onto the deck do not have to move upwardly to any significant extent. There can thus be a relatively smooth transition from the ground surface to the deck. For this, the deck can be constructed to sit within the opening of the gap so that the upper surface of the deck is close to flush with the ground surface on either side of the gap. The leading and trailing ends of the deck can include short ramps to facilitate this relatively smooth transition from the ground surface to the deck.

The deck can connect to the rails by welding, bolting or nesting arrangements. Where the rails are formed as I-beams, the deck can be attached to the bottom flange of the I-beam for example.

Where the bridge section includes rails for resting on the ground surface on either side of a gap that the deck traverses, the rails will extend beyond the leading and trailing ends of the deck. The rails can therefore be positioned to avoid interaction with the feet of the beams during relative movement between the beams and the bridge section in the first and second modes of operation, so that the extent of that relative movement is not reduced. The sections of the rails that extend beyond the leading and trailing ends of the deck can thus be offset from the feet of the beams, or the feet can include openings to allow the rails to extend through the feet.

The bridge section, or the deck of the bridge section, can include a plurality of beams or planks (hereinafter 'planks') that extend generally perpendicular to the lengthwise direction of the beams. The planks can be box or I-beans for example. The planks can have a length to extend fully across the gap, perpendicular to the beams, or can have a reduced length. The arrangement can allow planks to added or removed to suit the dimension of the gap to be traversed. The planks can abut together to form a generally continuous or uninterrupted deck surface, or the planks can be spaced apart to reduce the number of planks required and thus the weight of the bridge section. The upper surface of the planks can support an additional deck surface.

The bridge section can be steerable so that the crawler bridge can be maneuvered to follow the path of the tunnel or to correct misalignment that might occur as the crawler bridge moves along the tunnel. The amount of correction that is required will usually be low and so the steering capacity of the bridge section can likewise be minimal. In one form of the invention, the bridge section includes a steering facility that can be brought into engagement with the ground surface to turn the crawler bridge to the left or right. The steering facility can be a steering plate that is part of the bottom of the bridge section and which engages the ground surface when the bridge section engages the ground surface. Alternatively, the steering facility can be a wheel or wheels for example.

Where the steering facility is a plate, the plate can be engageable with the ground surface and can be shiftable relative to the beams, so that by engaging the ground surface and by shifting relative to the beams, the orientation of the beams can be altered to change the direction of travel of the crawler bridge. The steering facility is preferably activated when the crawler bridge is in the second mode of operation in which the bridge section has been moved into engagement with the ground surface and the beams have been lifted away from engagement with the supporting surface, so that the beams are free to be re-oriented.

The crawler bridge can alternatively steer through the beams and this can be by a swivel arrangement that allows the beams to swivel relative to the bridge section, or the feet of the beams can include wheels or rollers that can be driven to re-orient the beams. Accordingly, various steering arrangements can be employed to steer either the beams or the bridge section.

In addition to the bridge section, the crawler bridge can include a walkway for passage of personnel and smaller objects, such as trolleys etc. This can be for safety purposes so that pedestrian traffic can be separated from construction vehicle traffic. A walkway can extend outwardly from the bridge section for example and can be part of the bridge section, or can be an addition to the bridge section, such as by bolting to the bridge section. The walkway can alternatively be connected to one of the beams. Walkways can be included on either side of the crawler bridge to provide additional pedestrian capacity.

BRIEF DESCRIPTION OF THE DRAWINGS

In order that the invention may be more fully understood, some embodiments will now be described with reference to the figures in which.

DETAILED DESCRIPTION OF THE DRAWINGS

Figure 1:
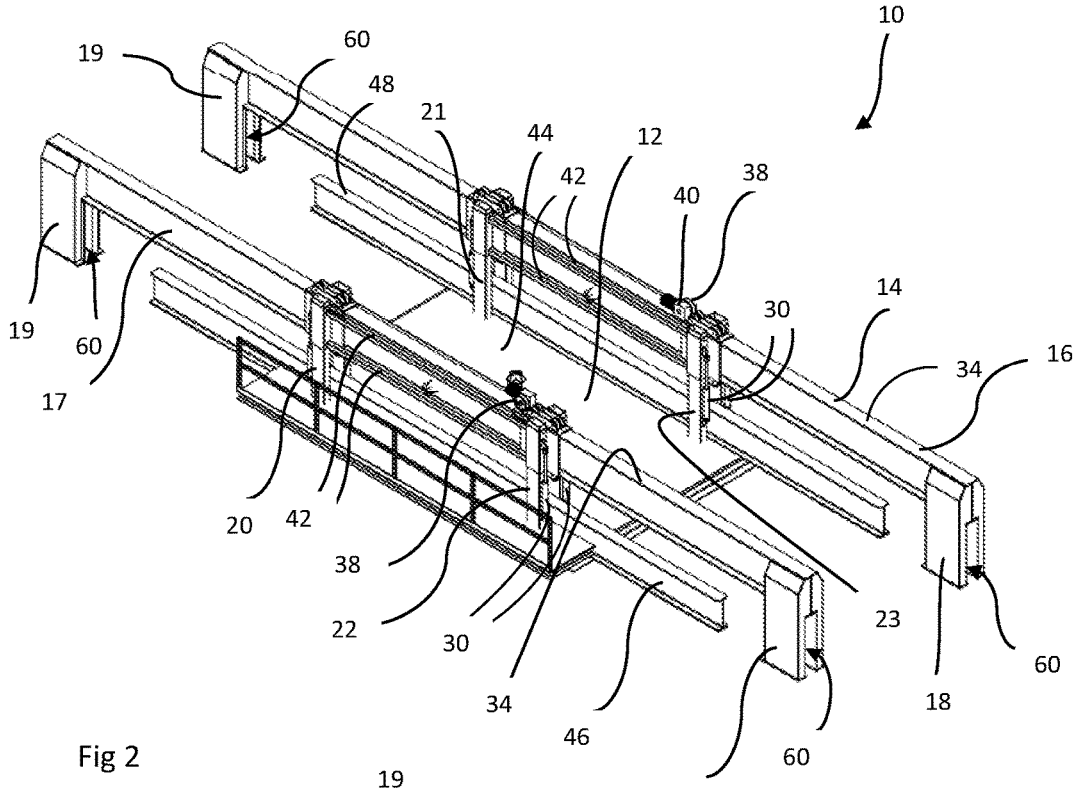
FIG. 1 is a perspective view from above of a crawler bridge according to one embodiment of the present invention.

FIG. 1 illustrates a crawler bridge according to one embodiment of the present invention. The crawler bridge 10 includes a bridge section 12 and a support structure 14. The support structure 14 supports the bridge section 12 as will become apparent hereinafter.

The support structure 14 includes a pair of elongate beams 16 and 17 that are formed as I-beams having upper and lower flanges connected by a central web. The beams 16 and 17 each have leading and trailing feet 18 and 19 that extend downwardly from the generally horizontal beams 16 and 17. Bottom ends of the feet 18 and 19 that are remote from the connection of the feet 18 and 19 with the beams 16 and 17 are provided for engagement with a ground surface of the tunnel, which can be a road deck or road surface for example. The designation of the feet as being leading or trailing is relevant for travel of the crawler bridge 10 in one direction. As the crawler bridge 10 can travel forward and back, the feet can be leading or trailing dependent on the direction of travel.

The bridge section 12 is attached to the beams 16 and 17 and is suspended therefrom. In FIG. 1, the bridge section 12 is suspended from the beams 16 and 17 by four arms 20 to 23, which form part of the support structure 14. As the arms 20 to 23 are identical, only the arm 20 is shown in more detail in FIG. 3. From this, it can be seen that the arm 20 connects to a box structure 24 that extends about the beam 16 and the box structure includes a sleeve 26 that accepts a post 28, which is an upper end of the arm 20. The post 28 can shift within the sleeve 26, relative to the sleeve 26 so that the sleeve and post represent a telescopic arrangement. The shifting movement is driven by a pneumatic strut 30. The post, sleeve and strut arrangement is repeated or duplicated on the opposite side of the beam 16, although it is mostly obscured in FIG. 3. The pair of struts 30 associated with each of the arms 20 to 23 provides an equal lifting or lowering load between the sleeves 26 and the posts 28.

Figure 4:
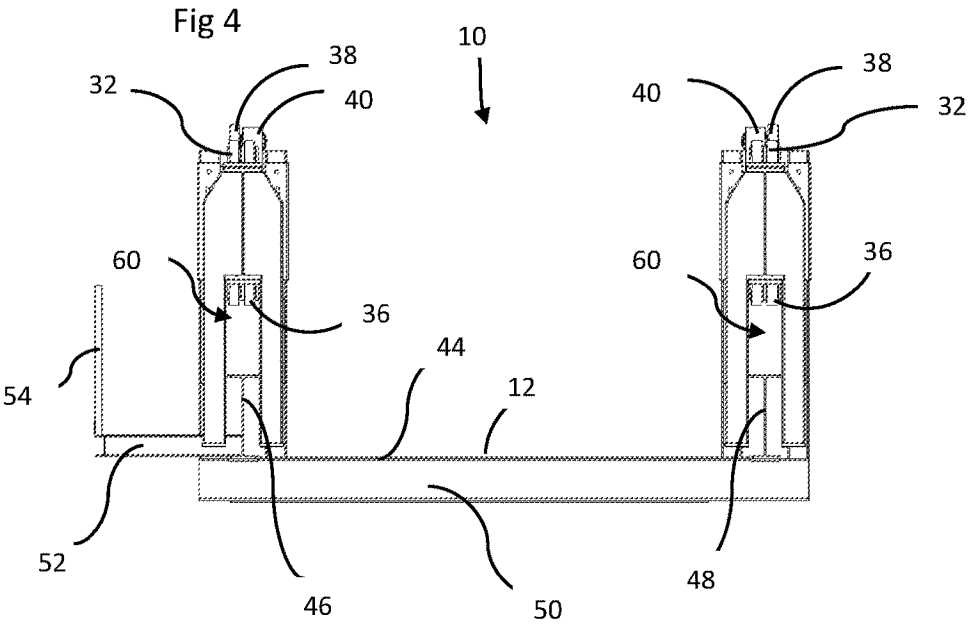
FIG. 4 is an end view of the crawler bridge of FIG. 1.
Figure 3:
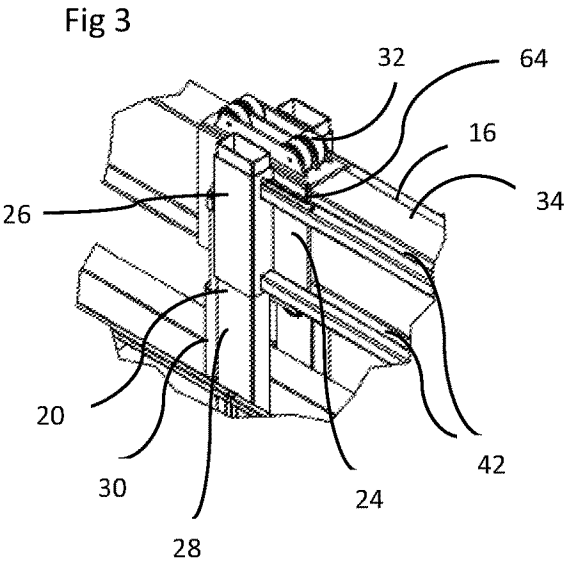
FIG. 3 is a detailed view of an arm of the crawler bridge of FIG. 1.
Figure 5:
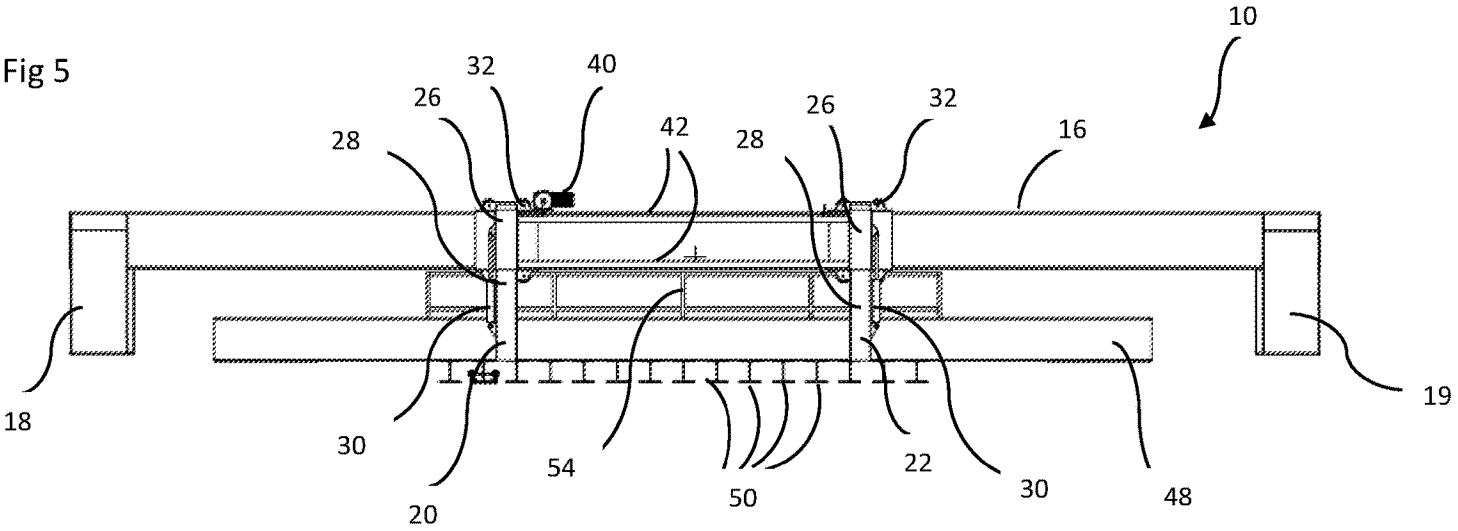
FIG. 5 is a side view of the crawler bridge of FIG. 1.

Further evident in FIG. 3 is the upper set of rollers 32 which roll along the upper flange surface 34 of the beam 16. As shown in FIG. 4, the arms 20 to 23 further include lower rollers 36 to roll along the downwardly facing surface of the lower flange of the beams 16 and 17. The upper rollers 32 bear the major weight of the bridge section 12 in the first mode of operation where the bridge section is suspended from the beams 16 and 17 for movement along the beams, whereas the lower rollers 36 bear the major weight of the beams 16 and 17 in the second mode of operation where the beams 16 and 17 are lifted from the ground surface for movement relative to the bridge section 12.

To drive the bridge section 12 along the length of the beams 16 and 17, a pair of driven rollers 38 are associated with each of the arms 22 and 23. The rollers 38 are each driven by an electric motor 40 and the drive is by frictional engagement between the rollers 38 and the flange surface 34 of the beams 16 and 17.

To maintain separation between the arms 20 and 22, and 21 and 23, rods 42 extend between the arms on each side of the beams 16 and 17.

A bottom end of the arms 20 to 23 connects to the bridge section 12. The arms 20 to 23 extend on opposite sides of rails 46 and 48 and can connect to the rails 46 and 48 as well. The rails 46 and 48 are also formed I-beams, having top and bottom flanges connected by a central web.

Figure 2:
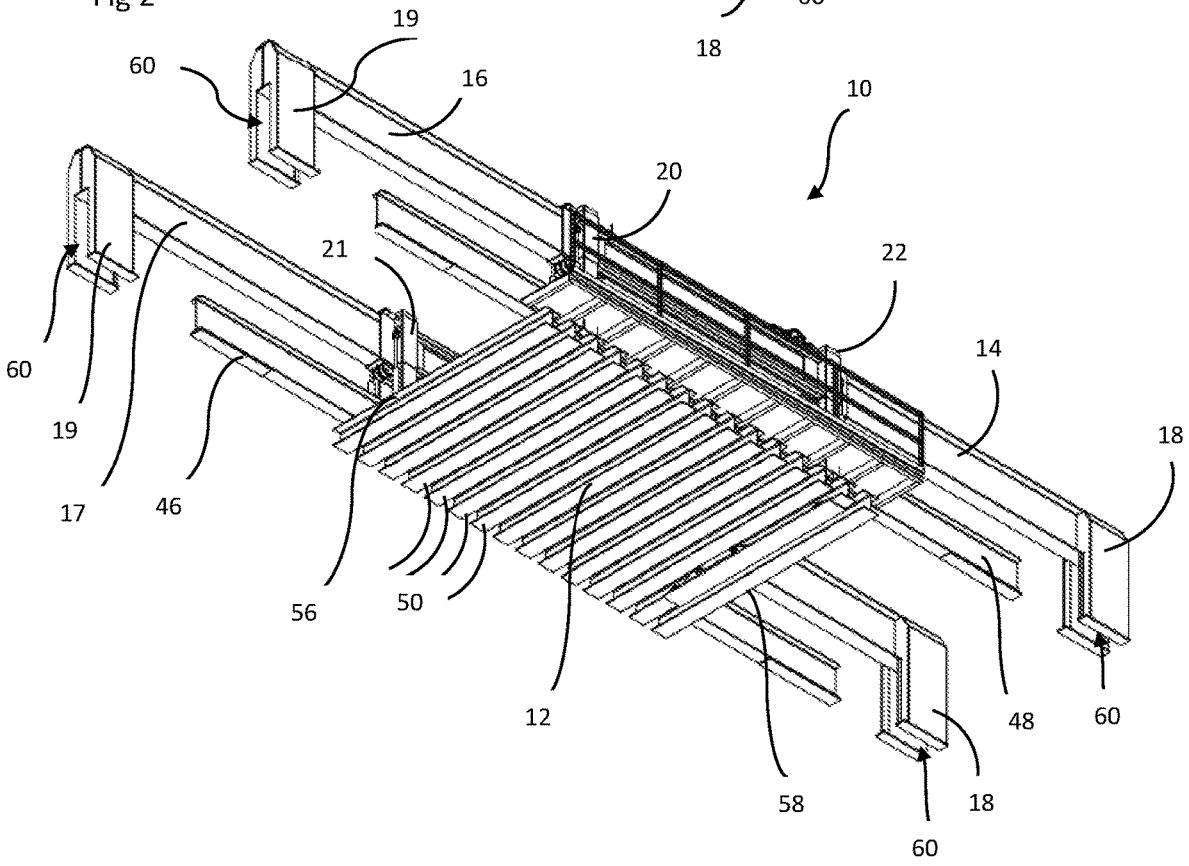
FIG. 2 is a perspective view from below of the crawler bridge of FIG. 1.

The bridge deck 44 of the bridge section 12 has a continuous upper surface, formed over a series of I-beam "planks" 50 which are shown in the underneath view of the crawler bridge 10 of FIG. 2. The planks 50 connect to the bottom flange of the rails 46 and 48 and extend generally perpendicular to the lengthwise extent of the beams 16 and 17.

As clearly shown in FIG. 4, a pedestrian walkway 52 extends from one side of the bridge section 12 and includes an upstanding handrail, fence or barrier 54.

It will be understood from the foregoing description, that by virtue of the arms 20 to 23 being movable along or relative to the beams 16 to 17, that the bridge section 12 can shift forward and backwards relative to the feet 18 and 19 of the beams 16 and 17. As described above, this is a first mode of operation of the crawler bridge 10 in which, with the leading feet 18 and trailing feet 19 engaged on a ground surface, the struts 30 of the arms 20 to 23 can raise the bridge section 12 away from the ground surface to allow freedom of movement of the arms 20 to 23 and thus the bridge section 12 along the beams 16 and 17.

However, in a second mode of operation, the struts 30 can lower the bridge section 12 into engagement with the ground surface and continuing activation of the struts 30 will lift the beams 16 and 17 away from the ground surface. In that condition, the beams 16 and 17 can move relative to the arms 20 to 23 and the bridge section 12 forwards and backwards relative to the bridge section 12. These two forms of relative movement between the arms 20 to 23 and the bridge section 12 is facilitated in both cases by the driven rollers 38.

It can be seen in FIGS. 1 and 2, that the rails 46 and 48 extend beyond the lengthwise ends 56 and 58 of the bridge section 12. These extensions are provided to rest on either side of a gap which has been bridged by the bridge section 12. These extensions can extend or pass through openings 60 in the feet 18 and 19 of the beams 16 and 17 during relative movement of the bridge section 12 and the beams 16 and 17, to ensure maximum travel of the bridge section 12 relative to the beams 16 and 17.

Operation of the crawler bridge 10 through the first and second modes of operation is illustrated in FIGS. 6 to 11. Each of these figures shows a roadway 62 that is formed with a gap G that has a lengthwise dimension of 7.2 m. The gap G can be the opening of a void beneath the roadway 62 that can be from 2 m to 3 m deep. The gap G can be provided to facilitate construction of cross passages between adjacent tunnels. Clearly, such a gap G will prevent vehicles and pedestrians from moving from one side of the roadway 62 to the other side unless a bridge is formed over the gap G.

Figures 6, 7, 8, 9, 10, 11:
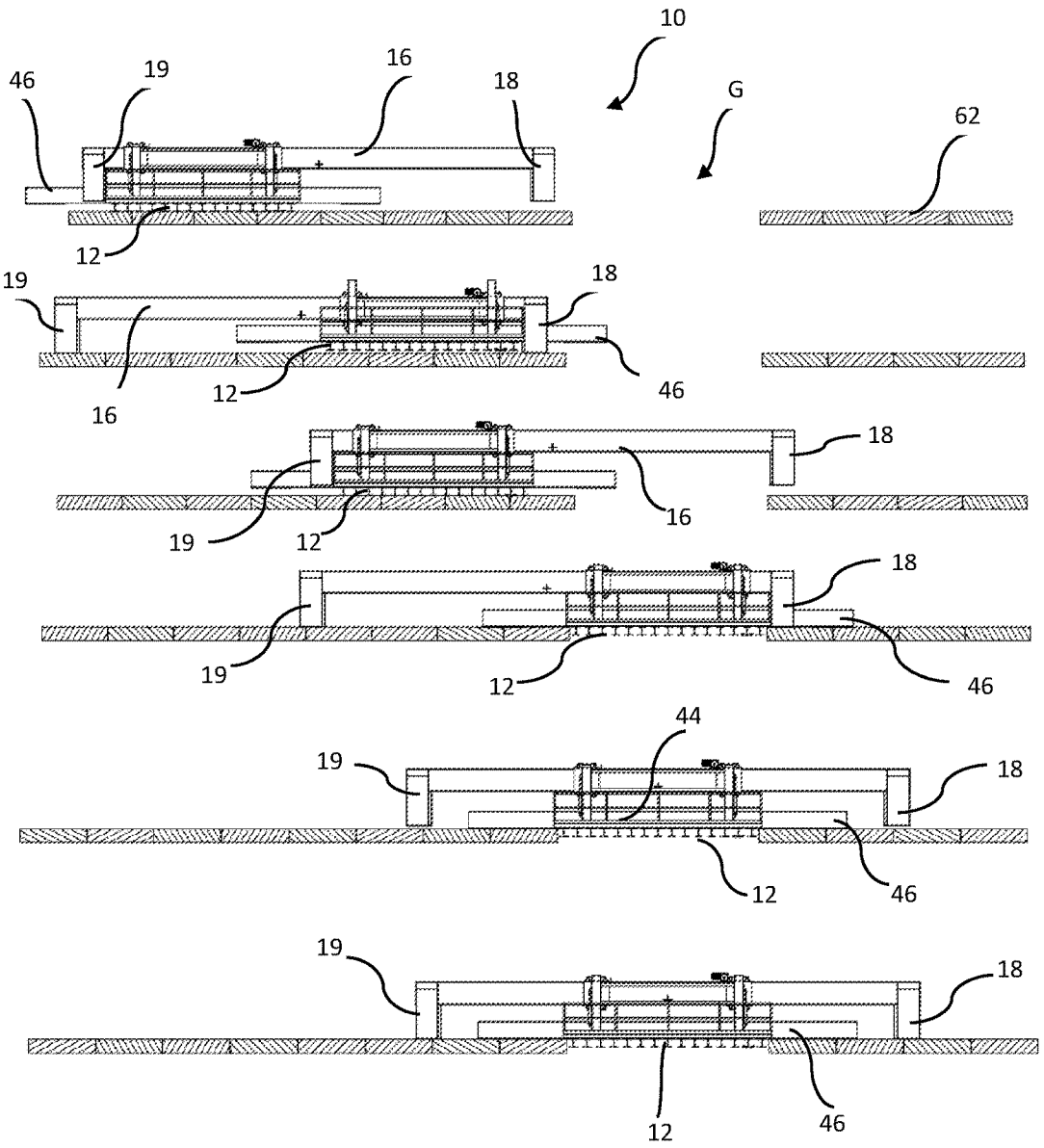
FIGS. 6 to 11 illustrate a sequence of operation of the crawler bridge of FIG. 1 as applied to a roadway having a gap.

FIG. 6 shows the crawler bridge 10 in place on the left-hand side of the roadway 62. The terms 'left-hand' and 'right-hand' side will be used in the discussion of FIGS. 6 to 11 but it will be clear that the crawler bridge 10 is not restricted to movement in the direction shown in FIGS. 6 to 11. Moreover, the roadway 62 can be a road deck or a ground surface inside a tunnel. In the condition shown in FIG. 6, the bridge section 12 is in contact with the upper surface of the roadway 62. In the condition shown in FIG. 6, with the bridge section 12 in contact with the roadway 62, extension of the struts 30 lifts the beams 16 and 17 so that the feet 18 and 19 are lifted away from the surface of the roadway 62 as shown.

To initiate the first mode of operation of the crawler bridge 10 to shift the bridge section 12 towards the gap G, the beams 16 and 17 are lowered by action of the struts 30 to bring the feet 18 and 19 into engagement with the roadway 62. Continued activation of the struts 30 will lift the bridge section 12 away from the roadway 62 and suspend the bridge section 12 on the beams 16 and 17 above the roadway 62. In that condition, the bridge section 12 can the shift to the right along the beams 16 and 17 as shown in FIG. 7.

In the transition between FIGS. 6 and 7, it can be seen that the rail 46 extends through the foot 18 in FIG. 6, but in FIG. 7, the bridge section 12 and the rail 46 has shifted away from the foot 18 and now the rail 46 extends through the foot 19 (through the opening 60 of FIG. 2) to bring the bridge section 12 adjacent to the feet 18. This illustrates how the maximum travel of the bridge section 12 is obtained between the respective feet 18 and 19 of the beams 16 and 17.

In FIG. 7, the bridge section 12 cannot move any closer to the gap G in the roadway 62 as it is close to or even abutting against the feet 18. Thus, the struts 30 operate to lower the bridge section 12 into engagement with the roadway 62 and to lift the beams 16 and 17 away from the roadway 62. The beams can now be shifted relative to the bridge section 12 to the right, so that the feet 18 traverse over the gap to position them adjacent the roadway 62 on the opposite side of the gap G. This is the position shown in FIG. 8. In that position, the struts 30 can be activated to lift the bridge section 12 away from the roadway 62 to bring the feet 18 and 19 of the beams 16 and 17 into engagement with the roadway 62 on either side of the gap G. The bridge section 12 is then able to be moved to the right to position the bridge section 12 in alignment with the gap G and to be lowered over the gap G. This is the position shown in FIG. 9.

In FIG. 9, it can be seen that the extensions of the rail 46 to the left and right of the bridge deck 44 of the bridge section 12 rest against the roadway 62 on either side of the gap G, while the bridge deck 44 bridges across the gap G and provides a bridge for the passage of vehicles and personnel.

For structural stability, it is preferred that the beams 16 and 17 be shifted relative to the bridge section 12 once the bridge section 12 has been lowered to bridge the gap G as shown in FIG. 9. Thus, in the position shown in FIG. 9, the struts 30 are activated to lift the beams 16 and 17 away from the roadway 62 and the driven rollers 38 drive the beams 16 and 17 to position them substantially equidistantly on either side of the gap G. This is the position shown in FIG. 10, while FIG. 11 shows the beams 16 and 17 having been lowered so that the feet 18 and 19 engage the roadway 62.

For safety purposes, locking pins, one of which is shown at reference numeral 64 in FIG. 3 can be activated to engage between the sleeves 26 and posts 28, so that the bridge section 12 is held safely in place suspended from the beams 16 and 17 and with the rails 46 and 48 in bearing engagement with the roadway 62 on opposite sides of the gap G.

Once the bridging requirement for the gap G has been removed, the crawler bridge 10 can be shifted from the gap G utilizing a sequence which is similar to that shown in FIGS. 6 to 11. Firstly, any locking pins 64 would be disengaged and thereafter, the beams 16 and 17 would be lifted via the struts 30 and shifted to the right by the driven rollers 38. This would bring the feet 19 to the left-hand edge of the gap G, whereafter the beams 16 and 17 can be lowered and the bridge section 12 lifted to shift the bridge section 12 onto the roadway 62 on the right-hand side of the gap G. The beams 16 and 17 can then be lifted away from the roadway 62 and shifted further to the right and by this mechanism of one of the bridge section 12 and beams 16 and 17 being released from engagement with the roadway, moved to the right and being re-placed into engagement with the roadway, the crawler bridge 10 can slowly move (or "crawl") along the roadway 62 and away from the gap G. Current estimates are that the crawler bridge 10 which is illustrated would have a speed of somewhere in the region of 4 m/min.

Some tunnel excavations include a cross passage site approximately every 120 m. For each cross passage site, a gap will be left in the road deck, roadway or tunnel floor, requiring a bridge for travel over and past the gap. In such an arrangement, the crawler bridge 10 would cover the 120 m spacing between gaps in approximately 30 minutes.

The crawler bridge 10 would likely be assembled within a tunnel, rather than being installed in the tunnel in an already assembled state. Thus, the components of the crawler bridge 10 could be loaded into the tunnel and then largely bolted or welded together for subsequent use. Conveniently, use of the crawler bridge 10 means that cranes or other types of lifting equipment are not required within a tunnel for placing and removing bridge sections and in particular, the present invention alleviates difficulties with having to lift and place a large and heavy bridge section from one side of a gap (because access to the opposite side of the gap is not available because of the gap). While this would be relatively easy to do outside of a tunnel environment, the lack of headspace within a tunnel means that heavy lifting machinery is often not appropriate for placement of bridge sections across roadway gaps.

Still further, it will be appreciated from FIG. 4, that when the crawler bridge 10 is not in use over a gap in a roadway, vehicles and personnel can nevertheless continue to drive through the crawler bridge and so it's presence within the tunnel does not create an obstacle to traffic within the tunnel. This is in contrast with a crane or other form of lifting equipment which is bulky and heavy and thus likely to form an unwanted obstruction to the passage of other equipment and activities that occur during tunnel excavation.

Certain terminology has been used herein for convenience in reference only and will not be limiting. For example, up, down, top, bottom, back, right, left, forward, backward, upward, and downward refer to the crawler bridge as orientated in the view being referred to and are not intended to be limiting on the scope of the claims of this application.

Those skilled in the art will appreciate that the invention described herein is susceptible to variations and modifications other than those specifically described. It is understood that the invention includes all such variations and modifications which fall within the spirit and scope of the present invention.

The invention claimed is:

1. A crawler bridge having:

a: a bridge section for bridging across opposite sides of a gap, b: the bridge section being connected to a support structure, c: the support structure including a pair of elongate beams that are spaced apart and generally parallel, the beams each including leading and trailing feet that extend downwardly from the beams for engagement with a ground surface, d: the bridge section being attached to the beams for relative movement forward and backward along the beams and vertically up and down relative to the beams, e: the crawler bridge having a first mode of operation when the leading and trailing feet of the beams are in engagement with a ground surface, in which the bridge section is supported by the support structure elevated above the ground surface and is movable forward and backward along the beams and vertically up and down relative to the beams, and f: the crawler bridge having a second mode of operation when the bridge section has been moved downward relative to the beams and into engagement with a supporting surface, in which the leading and trailing feet of the beams are lifted away from the supporting surface and the beams are movable forward and backward relative to the bridge section and vertically up and down relative to the bridge section.

2. A crawler bridge according to claim 1, the support structure including arms that extend from the bridge section into engagement with the beams and the arms including a drive arrangement to drive the bridge section relative to the beams.

3. A crawler bridge according to claim 2, the arms being telescopic for lifting and lowering the bridge section.

4. A crawler bridge according to claim 1, the bridge section including a deck which has an upper surface for travel over the bridge section.

5. A crawler bridge according to claim 1, the bridge section including leading and trailing feet for engagement with a ground surface.

6. A crawler bridge according to claim 1, the bridge section including a deck and rails that extend from opposite ends of the deck to overlie the ground surface on either side of a gap when the bridge section is in position bridging the gap.

7. A crawler bridge according to claim 6, the deck including a pair of rails on either side of the deck.

8. A crawler bridge according to claim 7, ends of the rails forming leading and trailing feet.

9. A crawler bridge according to claim 6, an upper surface of the deck being at generally the same level as the lower surface of the rails so that with the lower surface of the rails extending to rest on the ground surface on either side of a gap, the upper surface of the deck is close to the ground surface on either side of the gap.

10. A crawler bridge according to claim 6, sections of the rails that extend beyond the leading and trailing ends of the deck being offset from the feet of the beams.

11. A crawler bridge according to claim 6, the feet of the beams including openings to allow sections of the rails that extend beyond the leading and trailing ends of the deck to extend through the feet.

12. A crawler bridge according to claim 1, the bridge section including a plurality of beams that extend generally perpendicular to the lengthwise direction of the beams.

13. A crawler bridge according to claim 1, the bridge section being steerable.

14. A crawler bridge according to claim 13, the bridge section including a steering facility that can be brought into engagement with a ground surface to turn the crawler bridge to the left or right.

15. A crawler bridge according to claim 14, the steering facility being a steering plate that is part of or overlies a bottom or underneath of the bridge section and which engages the ground surface when the bridge section engages the ground surface.

16. A crawler bridge according to claim 15, the steering plate being engageable with the ground surface and shiftable relative to the beams, to alter the orientation of the beams to change the direction of travel of the crawler bridge.

17. A crawler bridge according to claim 1, further including a walkway.

18. A method of operating a crawler bridge according to claim 1, the method including moving the crawler bridge along a tunnel excavation by utilising the first and second modes of operation.

19. A method according to claim 18, including moving the crawler bridge towards a gap in a ground surface by successive activation of the first and second modes of operation to place the bridge section adjacent the gap, then activating the second mode of operation to traverse the beams across the gap relative to the bridge section to place the leading feet of the beams on the opposite side of the gap, then activating the first mode of operation to traverse the bridge section along the beams and to align the bridge section over the gap, then lowering the bridge section to bridge across the gap.

20. A method according to claim 19, including activating the second mode of operation to traverse the beams to position the leading and trailing feet of the beams substantially equidistantly on opposite sides of the gap.

* * * * *